US008800651B2

(12) United States Patent
Fripp et al.

(10) Patent No.: US 8,800,651 B2
(45) Date of Patent: Aug. 12, 2014

(54) ESTIMATING A WELLBORE PARAMETER

(75) Inventors: Michael Linley Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 369 days.

(21) Appl. No.: 13/182,508

(22) Filed: Jul. 14, 2011

(65) Prior Publication Data

US 2013/0014940 A1 Jan. 17, 2013

(51) Int. Cl.
*E21B 43/24* (2006.01)

(52) U.S. Cl.
USPC ..... 166/250.06; 166/272.1; 166/288

(58) Field of Classification Search
CPC ... E21B 43/2406; E21B 43/166; E21B 43/24; E21B 36/02; E21B 43/243
USPC ..... 166/250.06, 272.1, 272.3, 288, 302, 58, 166/59
See application file for complete search history.

(56) References Cited

U.S. PATENT DOCUMENTS

| | | | | |
|---|---|---|---|---|
| 3,982,591 | A | 9/1976 | Hamrick et al. | |
| 4,077,469 | A | 3/1978 | Hamrick et al. | |
| 4,234,042 | A * | 11/1980 | Kirkpatrick et al. | 166/261 |
| 4,385,661 | A | 5/1983 | Fox | |
| 4,423,780 | A | 1/1984 | Vigneri et al. | |
| 4,930,454 | A * | 6/1990 | Latty et al. | 122/4 D |
| 4,986,352 | A | 1/1991 | Alameddine | |
| 6,016,867 | A | 1/2000 | Gregoli et al. | |
| 6,848,503 | B2 | 2/2005 | Schultz et al. | |
| 7,165,608 | B2 | 1/2007 | Schultz et al. | |
| 7,246,660 | B2 | 7/2007 | Fripp et al. | |
| 7,270,141 | B2 | 9/2007 | Dykstra | |
| 7,308,379 | B2 | 12/2007 | Dykstra et al. | |
| 7,353,874 | B2 | 4/2008 | Dykstra et al. | |
| 7,356,427 | B2 | 4/2008 | Dykstra et al. | |
| 7,392,113 | B2 | 6/2008 | Dykstra | |
| 7,415,364 | B2 | 8/2008 | Mazrooee et al. | |
| 7,428,922 | B2 | 9/2008 | Fripp et al. | |

(Continued)

FOREIGN PATENT DOCUMENTS

| | | |
|---|---|---|
| EP | 0072675 B1 | 10/1986 |
| WO | WO 2009 009336 A2 | 1/2009 |

OTHER PUBLICATIONS

A.J. Mulac, et al., "Project Deep Stream Preliminary Field Test" Sandia National Laboratories, Apr. 1981 (34 pages).

(Continued)

*Primary Examiner* — Yong-Suk (Philip) Ro
(74) *Attorney, Agent, or Firm* — Scott F. Wendorf; Fish & Richardson P.C.

(57) ABSTRACT

A system for estimating a wellbore parameter includes a first component located at or near a terranean surface; a second component at least partially disposed within a wellbore at or near a subterranean zone; and a controller communicably coupled to the first and second components. The second component is associated with a sensor. The controller is operable to: adjust a characteristic of an input fluid to the wellbore through a range of input values; receive, from the sensor, a plurality of output values of the input fluid that vary in response to the input values, the output values representative of a downhole condition; and estimate a wellbore parameter distinct from the downhole condition based on the measured output values.

27 Claims, 3 Drawing Sheets

(56) References Cited

U.S. PATENT DOCUMENTS

| | | | |
|---|---|---|---|
| 7,433,762 | B2 | 10/2008 | Dykstra |
| 7,494,263 | B2 | 2/2009 | Dykstra et al. |
| 7,516,793 | B2 | 4/2009 | Dykstra |
| 7,543,645 | B2 | 6/2009 | Dykstra et al. |
| 7,561,943 | B2 | 7/2009 | Dykstra et al. |
| 7,567,856 | B2 | 7/2009 | Dykstra et al. |
| 7,574,325 | B2 | 8/2009 | Dykstra |
| 7,606,636 | B2 | 10/2009 | Dykstra |
| 7,620,481 | B2 | 11/2009 | Dykstra |
| 7,636,614 | B2 | 12/2009 | Dykstra |
| 7,660,648 | B2 | 2/2010 | Dykstra |
| 7,680,617 | B2 | 3/2010 | Mazrooee et al. |
| 7,686,499 | B2 | 3/2010 | Dykstra et al. |
| 7,809,538 | B2 | 10/2010 | Thomas |
| 7,836,949 | B2 | 11/2010 | Dykstra |
| 7,891,423 | B2 | 2/2011 | Dykstra |
| 2003/0131986 | A1 | 7/2003 | Schultz et al. |
| 2003/0166470 | A1 | 9/2003 | Fripp et al. |
| 2005/0039921 | A1 | 2/2005 | Schultz et al. |
| 2005/0051323 | A1 | 3/2005 | Fripp et al. |
| 2006/0112701 | A1 | 6/2006 | Dykstra |
| 2006/0118170 | A1 | 6/2006 | Dykstra |
| 2006/0161358 | A1 | 7/2006 | Dykstra et al. |
| 2006/0176640 | A1 | 8/2006 | Dykstra |
| 2006/0177203 | A1 | 8/2006 | Dykstra |
| 2006/0231259 | A1 | 10/2006 | Dykstra et al. |
| 2006/0233039 | A1 | 10/2006 | Dykstra et al. |
| 2006/0235627 | A1 | 10/2006 | Dykstra et al. |
| 2007/0003831 | A1 | 1/2007 | Fripp et al. |
| 2007/0153622 | A1 | 7/2007 | Dykstra et al. |
| 2007/0153623 | A1 | 7/2007 | Dykstra et al. |
| 2007/0153624 | A1 | 7/2007 | Dykstra et al. |
| 2007/0168170 | A1 | 7/2007 | Thomas |
| 2007/0171765 | A1 | 7/2007 | Dykstra et al. |
| 2007/0295924 | A1 | 12/2007 | Clausen |
| 2008/0030365 | A1 | 2/2008 | Fripp et al. |
| 2008/0084783 | A1 | 4/2008 | Mazrooee et al. |
| 2008/0114554 | A1 | 5/2008 | Mazrooee et al. |
| 2008/0164021 | A1 | 7/2008 | Dykstra |
| 2008/0164023 | A1 | 7/2008 | Dykstra et al. |
| 2008/0165612 | A1 | 7/2008 | Dykstra |
| 2008/0165613 | A1 | 7/2008 | Dykstra |
| 2008/0179056 | A1 | 7/2008 | Dykstra |
| 2008/0183310 | A1 | 7/2008 | Dykstra |
| 2008/0183336 | A1 | 7/2008 | Dykstra |
| 2008/0183415 | A1 | 7/2008 | Dykstra |
| 2008/0236818 | A1 | 10/2008 | Dykstra |
| 2009/0008096 | A1 | 1/2009 | Schultz et al. |
| 2009/0055141 | A1 | 2/2009 | Moncorget et al. |
| 2009/0118866 | A1 | 5/2009 | Dykstra et al. |
| 2010/0263861 | A1 | 10/2010 | Dykstra |
| 2011/0042091 | A1 | 2/2011 | Dykstra et al. |
| 2011/0042092 | A1 | 2/2011 | Fripp et al. |
| 2011/0122727 | A1 | 5/2011 | Gleitman et al. |
| 2011/0168390 | A1 | 7/2011 | Fripp et al. |
| 2011/0186300 | A1 | 8/2011 | Dykstra et al. |
| 2011/0214876 | A1 | 9/2011 | Dykstra et al. |
| 2011/0240284 | A1 | 10/2011 | Hamid et al. |
| 2011/0265987 | A1 | 11/2011 | Wright et al. |
| 2011/0266001 | A1 | 11/2011 | Dykstra et al. |
| 2011/0297384 | A1 | 12/2011 | Fripp et al. |
| 2011/0297385 | A1 | 12/2011 | Dykstra et al. |
| 2011/0308806 | A9 | 12/2011 | Dykstra et al. |
| 2012/0018167 | A1 | 1/2012 | Konopczynski et al. |
| 2012/0059640 | A1 | 3/2012 | Roy et al. |
| 2012/0060624 | A1 | 3/2012 | Dykstra |
| 2012/0061088 | A1 | 3/2012 | Dykstra et al. |

OTHER PUBLICATIONS

Authorized officer Jong Kyung Lee, International Search Report and Written Opinion in International Application No. PCT/US2012/046156, mailed Jan. 21, 2013, 11 pages.

Authorized Officer Mineko Mohri, PCT International Preliminary Report on Patentability, PCT/US2012/046156, Jan. 23, 2014, 7 pages.

* cited by examiner

ESTIMATING A WELLBORE PARAMETER

TECHNICAL BACKGROUND

This disclosure relates to estimating a wellbore parameter in a wellbore operation.

BACKGROUND

In wellbore operations, such as drilling, production, stimulating, or other post-drilling activities, a variety of downhole conditions and/or wellbore parameters are monitored or measured. Given the inherent problems with measuring, determining, or otherwise calculating wellbore parameters, however, well operators are often left to estimate wellbore parameters with some uncertainty as to whether the estimates are accurate. While certain parameters can be measured with fairly high accuracy due to, for instance, highly accurate sensors (e.g., temperature, pressure, and other parameters), in some cases, there may not be an accurate sensor (or indeed any available sensor) for a particular parameter to be measured. Moreover, even if an accurate sensor is available, there may not be a communication path for the sensor.

One example of a downhole operation is a downhole heated fluid generator, such as, for example, a steam generator system that provides a fuel, air, and water to a downhole combustion chamber. The fuel, air, and water are mixed and burned in the combustion chamber. The heat from the combustion vaporizes the water (or other treatment fluid) into steam (or a heated liquid or multiphase fluid). In some aspects, it may be advantageous to know the steam quality and/or the combustion quality of the downhole steam generation. With the combustion occurring downhole, knowledge of the steam quality produced downhole by the combustor may help prevent (all or partially) various problems associated with steam quality in excess of, or below, a desired steam quality. Further, knowledge of the combustion quality may also be used to prevent (all or partially) various problems in the downhole combustion chamber.

Another example of a downhole operation is a gravel packing completion operation. This type of operation may include flowing gravel-laden fluid down an interior of a completion string, through a gravel port, and out into a formation proximate to the wellbore. The gravel-laden fluid may flow out through the casing perforations and into the formation, in part helping to prop the formation and enhance fluid flow, in part providing a barrier to propagation of fines and sand with fluid flow towards the completion string. The gravel packing completion operation may continue with packing gravel (or other particulates) around a completion string screen. The gravel packing may be tested by estimating a pressure differential across the gravel pack. In different circumstances different pressure differentials may be preferred, but certain differential pressures may be deemed an indication of a successful gravel pack.

DETAILED DESCRIPTION

Figure 1:
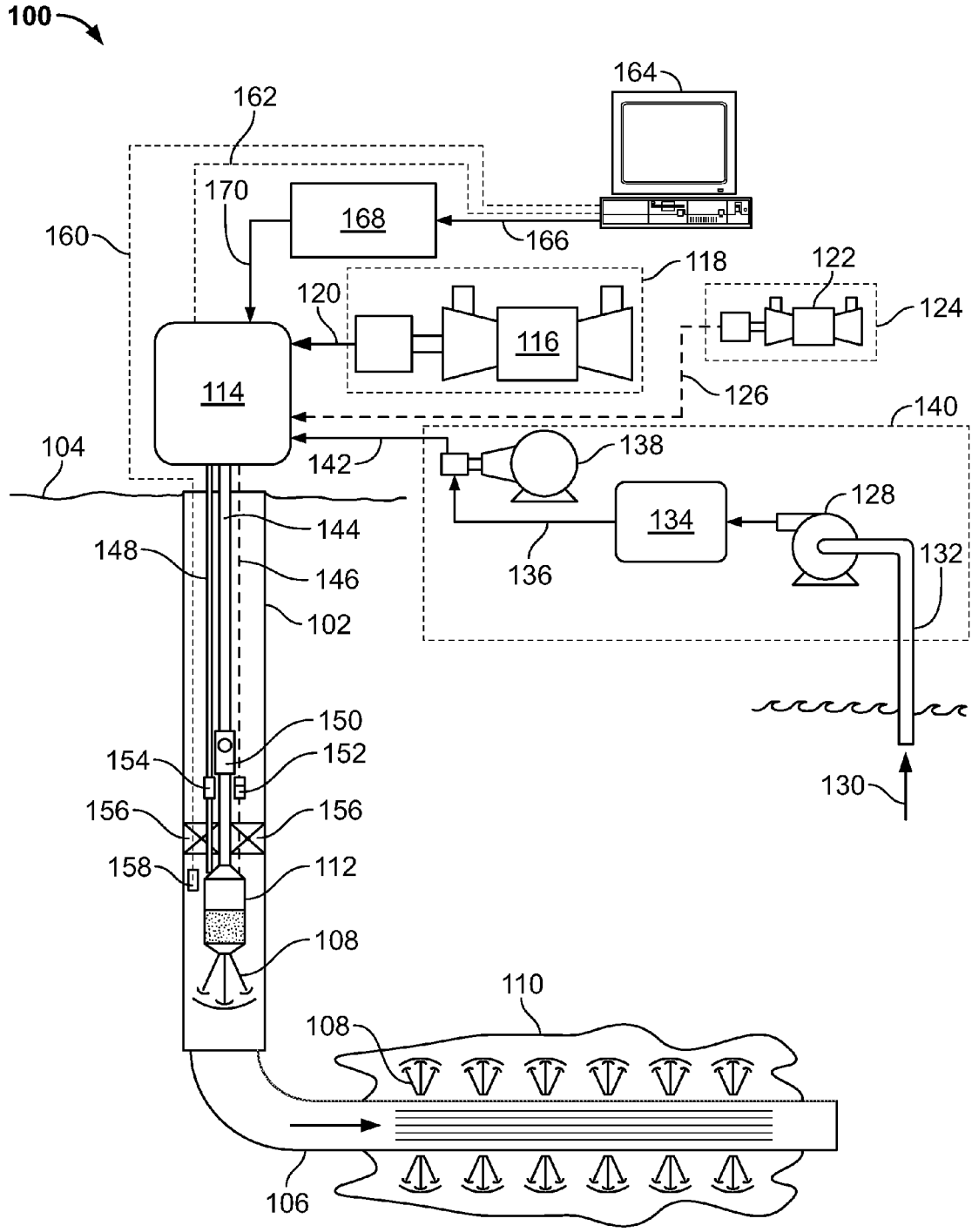
FIG. 1 illustrates an example embodiment of a heated fluid generation system.

The present disclosure relates to estimating a wellbore parameter in a wellbore operation that, in certain situations, may not be directly measurable, sensed, or otherwise determined. Further, in certain situations there may not be available communication between a sensor operable to sense the wellbore parameter and an actuator. In some embodiments, a wellbore parameter may be estimated by sweeping an input value to a downhole system, measuring an output value related to the input value that is detected in a wellbore, and estimating the wellbore parameter based on the measured output value. For example, in some embodiments, the estimated wellbore parameter may be a parameter related to a downhole heated fluid generation system including a downhole combustor. For instance, the estimated wellbore parameter may be a fluid quality, such as a steam quality when steam is used as a treatment fluid for a subterranean zone. For example, the steam quality may be the proportion of saturated steam in a saturated water/steam mixture (i.e., a steam quality of 0 indicates 100% water while a steam quality of 100% indicates 100% steam). The treated subterranean zone can include all or a portion of a resource bearing subterranean formation, multiple resource bearing subterranean formations, or all or part of one or more other intervals that it is desired to treat with the heated fluid. The fluid is heated, at least in part, using heat recovered from a nearby (e.g., on a terranean surface) operation. The heated fluid can be used to reduce the viscosity of resources in the subterranean zone to enhance recovery of those resources. In some embodiments, the system for treating a subterranean zone using heated fluid may be suitable for use in a "huff and puff" process, where heated fluid is injected through the same bore in which resources are recovered. For example, the heated fluid may be injected for a specified period, then resources withdrawn for a specified period. The cycles of injecting heated fluid and recovering resources can be repeated numerous times. Additionally, the systems and techniques of the present disclosure may be used in a Steam Assisted Gravity Drainage ("SAGD").

In one general embodiment, a method includes adjusting a characteristic of an input fluid to a wellbore through a range of input values; measuring a plurality of output values of the input fluid that vary in response to the input values, the output values representative of a downhole condition; and estimating a wellbore parameter distinct from the downhole condition based on the measured output values.

In one aspect of the general embodiment, the plurality of output values of the input fluid may be measured in the wellbore.

In one aspect of the general embodiment, the downhole system may include a heated fluid generation system.

In one aspect of the general embodiment, the estimated wellbore parameter may be indicative of a mechanical health of the downhole system.

In one aspect of the general embodiment, the estimated wellbore parameter may include a steam quality.

In one aspect of the general embodiment, adjusting a characteristic of an input fluid may include adjusting a flow rate of the input fluid.

In one aspect of the general embodiment, the input fluid may include at least one of: a fuel used for combustion; air used for combustion; a combined of the fuel and the air used for combustion; or a treatment fluid delivered to a combustor of the heated fluid generation system.

In one aspect of the general embodiment, the measured output values may include a plurality of measured values representative of at least one of: a temperature of a heated fluid output from the heated fluid generation system used to treat a subterranean zone; a pressure of the heated fluid output from the heated fluid generation system used to treat a subterranean zone; an amount of oxygen in a wellbore at or near a downhole combustor in the heated fluid generation system; or a pressure drop across an orifice in the heated fluid generation system.

In one aspect of the general embodiment, the method may further include identifying a first output value among the plurality of output values, where the first output value is associated with a change to a rate of change of the downhole condition.

In one aspect of the general embodiment, the first output value may include at least one of: a value representative of an amount of combustion energy necessary to convert at least a portion of a treatment liquid supplied to a combustor of the heated fluid generation system to vapor; or a value representative of an amount of combustion energy necessary to convert substantially all of the treatment liquid supplied to the combustor of the heated fluid generation system to vapor.

In one aspect of the general embodiment, the method may further include based on the measured output values, calibrating at least one downhole sensor operable to measure the plurality of output values; and subsequent to the calibration, performing steps including adjusting the characteristic of the input fluid to the wellbore through a second range of input values; measuring a second plurality of output values of the input fluid that vary in response to the input values in the second range, the output values representative of the downhole condition; and estimating the wellbore parameter distinct from the downhole condition based on the measured second plurality of output values.

In one aspect of the general embodiment, adjusting a characteristic of an input fluid to a wellbore through a range of input values may include adjusting the characteristic of the input fluid at or near a terranean surface.

In one aspect of the general embodiment, the downhole system may be a gravel packing system.

In one aspect of the general embodiment, the estimated wellbore parameter may include a location of an injected particulate.

In one aspect of the general embodiment, the injected particulate includes at least one of gravel or proppant.

In another general embodiment, a system for estimating a wellbore parameter includes a first component located at or near a terranean surface; a second component at least partially disposed within a wellbore at or near a subterranean zone, the second component associated with a sensor; and a controller communicably coupled to the first and second components operable to: adjust a characteristic of an input fluid to the wellbore through a range of input values; receive, from the sensor, a plurality of output values of the input fluid that vary in response to the input values, the output values representative of a downhole condition; and estimate a wellbore parameter distinct from the downhole condition based on the measured output values.

In one aspect of the general embodiment, the first and second components may include at least a portion of one of: a heated fluid generation system; or a gravel packing system.

In one aspect of the general embodiment, the estimated wellbore parameter may include a steam quality.

In one aspect of the general embodiment, the characteristic of the input fluid may include a flow rate of at least one fluid used for combustion in the heated fluid generation system.

In one aspect of the general embodiment, the flow rate of the at least one fluid used for combustion may include at least one of: a flow rate of a fuel used for combustion; a flow rate of air used for combustion; or a combined mass flow rate of the fuel and air used for combustion.

In one aspect of the general embodiment, the characteristic of the input fluid may include a flow rate of a treatment fluid delivered to a combustor of the heated fluid generation system.

In one aspect of the general embodiment, the measured output values may include a plurality of measured values representative of at least one of: a temperature of a heated fluid output from the heated fluid generation system used to treat the subterranean zone; a pressure of the heated fluid output from the heated fluid generation system used to treat the subterranean zone; an amount of oxygen in the wellbore at or near a downhole combustor in the heated fluid generation system; a pressure drop across an orifice in the heated fluid generation system; or a pressure differential across a gravel pack at least partially disposed in the wellbore.

In one aspect of the general embodiment, the controller is further operable to identify a first output value among the plurality of output values, wherein the first output value is associated with a change to a rate of change of the downhole condition.

In one aspect of the general embodiment, the first output value may include at least one of: a value representative of an amount of combustion energy necessary to convert at least a portion of a treatment liquid supplied to a combustor of the heated fluid generation system to vapor; or a value representative of an amount of combustion energy necessary to convert substantially all of the treatment liquid supplied to the combustor of the heated fluid generation system to vapor.

In another general embodiment, a method includes sweeping a flow rate of at least one input fluid of a heated fluid generation system through a first range of input values, the heated fluid generation system including a downhole sensing device and a heated fluid generator operable to deliver a heated fluid to a subterranean zone; in response to sweeping the flow rate of the input fluid, receiving at least one output value from the downhole sensing device representative of a state of the heated fluid at a particular input value; and estimating a wellbore parameter associated with the heated fluid based on the received output value.

In one aspect of the general embodiment, the wellbore parameter may be an unmeasurable state of the heated fluid.

In one aspect of the general embodiment, the method may further include determining a first input value in the first range of input values, the first input value approximating a flow rate of the input fluid associated with a change in a rate of change of the state of the heated fluid; based on the first input value, determining a second range of input values that includes the first input value, the second range smaller than the first range; sweeping the input fluid through the second range of input values; and determining a second input value in the second range of input values, the second input value substantially corresponding to the flow rate of the input fluid associated with the change in the rate of change of the state of the heated fluid.

In one aspect of the general embodiment, the method may further include linearly extrapolating a plurality of input values outside of the first range of input values based on the second input value.

In one aspect of the general embodiment, the method may further include taking a remedial action to the heated fluid generation system based on the estimated wellbore parameter.

In one aspect of the general embodiment, the estimated wellbore parameter may be a steam quality.

Moreover, one aspect of a control system for estimating a wellbore parameter may include the features of adjusting a characteristic of an input fluid to a wellbore through a range of input values; and estimating a wellbore parameter distinct from the downhole condition based on measured output values.

A first aspect according to any of the preceding aspects may also include the feature of measuring the plurality of output values of the input fluid that vary in response to the input values.

A second aspect according to any of the preceding aspects may also include the feature of the output values representative of a downhole condition.

A third aspect according to any of the preceding aspects may also include the feature of the plurality of output values of the input fluid are measured in the wellbore.

A fourth aspect according to any of the preceding aspects may also include the feature of the downhole system is a heated fluid generation system.

A fifth aspect according to any of the preceding aspects may also include the feature of the estimated wellbore parameter is indicative of a mechanical health of the downhole system.

A sixth aspect according to any of the preceding aspects may also include the feature of the estimated wellbore parameter is a steam quality.

A seventh aspect according to any of the preceding aspects may also include the feature of adjusting a flow rate of the input fluid.

An eighth aspect according to any of the preceding aspects may also include the feature of the input fluid including at least one of: a fuel used for combustion; air used for combustion; a combined of the fuel and the air used for combustion; or a treatment fluid delivered to a combustor of the heated fluid generation system.

A ninth aspect according to any of the preceding aspects may also include the feature of the measured output values including a plurality of measured values representative of at least one of: a temperature of a heated fluid output from the heated fluid generation system used to treat a subterranean zone; a pressure of the heated fluid output from the heated fluid generation system used to treat a subterranean zone; an amount of oxygen in a wellbore at or near a downhole combustor in the heated fluid generation system; or a pressure drop across an orifice in the heated fluid generation system.

A tenth aspect according to any of the preceding aspects may also include the feature of identifying a first output value among the plurality of output values, wherein the first output value is associated with a change to a rate of change of the downhole condition.

An eleventh aspect according to any of the preceding aspects may also include the feature of the first output value includes at least one of: a value representative of an amount of combustion energy necessary to convert at least a portion of a treatment liquid supplied to a combustor of the heated fluid generation system to vapor; and a value representative of an amount of combustion energy necessary to convert substantially all of the treatment liquid supplied to the combustor of the heated fluid generation system to vapor.

A twelfth aspect according to any of the preceding aspects may also include the feature of based on the measured output values, calibrating at least one downhole sensor operable to measure the plurality of output values.

A thirteenth aspect according to any of the preceding aspects may also include the feature of subsequent to the calibration, adjusting the characteristic of the input fluid to the wellbore through a second range of input values.

A fourteenth aspect according to any of the preceding aspects may also include the feature of measuring a second plurality of output values of the input fluid that vary in response to the input values in the second range.

A fifteenth aspect according to any of the preceding aspects may also include the feature of the output values representative of the downhole condition.

A sixteenth aspect according to any of the preceding aspects may also include the feature of estimating the wellbore parameter distinct from the downhole condition based on the measured second plurality of output values.

A seventeenth aspect according to any of the preceding aspects may also include the feature of adjusting the characteristic of the input fluid at or near a terranean surface.

An eighteenth aspect according to any of the preceding aspects may also include the feature of the downhole system is a gravel packing system.

A nineteenth aspect according to any of the preceding aspects may also include the feature of the estimated wellbore parameter is a location of an injected particulate.

A twentieth aspect according to any of the preceding aspects may also include the feature of the injected particulate is at least one of gravel or proppant.

A twenty-first aspect according to any of the preceding aspects may also include the feature of the wellbore parameter is an unmeasurable state of the heated fluid.

A twenty-second aspect according to any of the preceding aspects may also include the feature of determining a first input value in the first range of input values.

A twenty-third aspect according to any of the preceding aspects may also include the feature of the first input value approximating a flow rate of the input fluid associated with a change in a rate of change of the state of the heated fluid.

A twenty-fourth aspect according to any of the preceding aspects may also include the feature of based on the first input value, determining a second range of input values that includes the first input value.

A twenty-fifth aspect according to any of the preceding aspects may also include the feature of the second range smaller than the first range.

A twenty-sixth aspect according to any of the preceding aspects may also include the feature of sweeping the input fluid through the second range of input values.

A twenty-seventh aspect according to any of the preceding aspects may also include the feature of determining a second input value in the second range of input values.

A twenty-eighth aspect according to any of the preceding aspects may also include the feature of the second input value substantially corresponding to the flow rate of the input fluid associated with the change in the rate of change of the state of the heated fluid.

A twenty-ninth aspect according to any of the preceding aspects may also include the feature of linearly extrapolating a plurality of input values outside of the first range of input values based on the second input value.

A thirtieth aspect according to any of the preceding aspects may also include the feature of taking a remedial action to the heated fluid generation system based on the estimated wellbore parameter.

Various embodiments of a control system for estimating a wellbore parameter based on sweeping an uphole parameter and measuring a measurable downhole condition according to the present disclosure may include one or more of the following features. For example, the system may estimate parameters that are quantitatively unmeasurable because, for example, there may be no sensor designed or available to measure the parameters, the downhole location may make it difficult or unfeasible to measure (directly or otherwise) the parameters, or for other reasons. The system, for example, may estimate a steam quality, a combustion quality, and/or a system health of a downhole steam generator based on a sweep of a measurable uphole (e.g., surface) parameter and a measurable wellbore parameter. These estimations may provide for a robust and efficient operation of a downhole steam generator, but in some cases, may be difficult to measure in the downhole location. Further, the system may prevent (all or partially) overheating a combustion chamber from too high steam quality. The system may minimize (most or substantially all) scaling from too high steam quality. The system may minimize (most or substantially all) inefficient injection of hot water from too low steam quality. The system may provide for an indication of scale formation and overall health of the downhole combustion chamber.

As a further example feature for a downhole steam generator, the control system may generate a numerical model of the downhole steam generator to estimate a steam quality. The numerical model may provide an observer-based estimator where various details of the downhole steam generator (e.g., the dynamics and time delays of the injection lines) would be included in the model to provide for a better understanding of the system health and a better understanding of which part of the steam generator is changing when the health is compromised. As another feature, the system may combine uphole measurements with the downhole measurements into a numerical model to provide the most accurate understanding of the downhole steam generator performance and health.

Example features of a control system for a gravel packing operation according to the present disclosure may include estimating one or more downhole properties, such as for example, a hydraulic fracturing of the formation, an impending screen out of the sand in the formation, a flow into multiple zones, and a progress of alpha and beta waves in the gravel pack. For instance, the sweeping of injection flow rate, injection pressure, particle concentration, injection gel strength, and/or particle size (as some examples) may allow for an estimation of such difficult-to-measure and difficult-to-transmit downhole properties.

FIG. 1 illustrates an example embodiment of a heated fluid generation system 100. System 100 may be used for treating resources in a subterranean zone for recovery using heated fluid that may be used in combination with other technologies for enhancing fluid resource recovery. In this example, the heated fluid comprises steam (of 100% quality or less). In certain instances, the heated fluid can include other liquids, gases or vapors in lieu of or in combination with the steam. For example, in certain instances, the heated fluid includes one or more of water, a solvent to hydrocarbons, carbon dioxide, nitrogen, and/or other fluids. In the example of FIG. 1, a vertical well bore 102 extends from a terranean surface 104 and intersects a subterranean zone 110, although the vertical well bore 102 may span multiple subterranean zones 110.

A portion of the vertical well bore 102 proximate to a subterranean zone 110 may be isolated from other portions of the vertical well bore 102 (e.g., using packers 156 or other devices) for treatment with heated fluid at only the desired location in the subterranean zone 110. Alternately, the vertical well bore 102 may be isolated in multiple portions to enable treatment with heated fluid at more than one location (i.e., multiple subterranean zones 110) simultaneously or substantially simultaneously, sequentially, or in any other order.

The length of the vertical well bore 102 may be lined or partially lined with a casing (not shown). The casing may be secured therein such as by cementing or any other manner to anchor the casing within the vertical well bore 102. However, casing may be omitted within all or a portion of the vertical well bore 102. Further, although the vertical well bore 102 is illustrated as a vertical well bore, the well bore 102 may be substantially (but not completely) vertical, accounting for drilling technologies used to form the vertical well bore 102.

In the illustrated embodiment, the vertical well bore 102 is coupled with a directional well bore 106, which, as shown, includes a radiussed portion and a substantially horizontal portion. Thus, in the illustrated embodiment, the combination of the vertical well bore 102 and the directional well bore 106 forms an articulated well bore extending from the terranean surface 104 into the subterranean zone 110. Of course, other configurations of well bores are within the scope of the present disclosure, such as other articulated well bores, slant well bores, horizontal well bores, directional well bores with laterals coupled thereto (e.g., multi-lateral wellbores), and any combination thereof.

As illustrated, heated fluid 108 is introduced into the well bore portions and, ultimately, into the subterranean zone 110 by heated fluid generator 112. The heated fluid generator 112 shown in FIG. 1 is a downhole heated fluid generator, although the heated fluid generator 112 may additionally or alternatively include a surface based heated fluid generator. In certain embodiments, the heated fluid generator 112 can include a catalytic combustor that includes a catalyst that promotes an oxidization reaction of a mixture of fuel and air without the need for an open flame. That is, the catalyst initiates and sustains the combustion of the fuel/air mixture.

Alternately (or additionally), the heated fluid generator 112 may include one or more other types of combustors. Some examples of combustors (but not exhaustive) include, a direct fired combustor where the fuel and air are burned at burner and the flame from the burner heats a boiler chamber carrying the treatment fluid, a combustor where the fuel and air are combined in a combustion chamber and the treatment fluid is introduced to be heated by the combustion, or any other type combustor. In some instances, the combustion chamber can be configured as a pressure vessel to contain and direct pressure from the expansion of gasses during combustion to further pressurize the heated fluid and facilitate its injection into the subterranean zone 110. Expansion of the exhaust gases resulting from combustion of the fuel and air mixture in the combustion chamber provides a driving force at least partially responsible for heating and/or driving the treatment fluid into a region of the directional well bore 106 at or near the subterranean zone 110. The heated fluid generator 112 may also include a nozzle at an outlet of the combustion chamber to inject the heated fluid 108 into the well bore portions and/or subterranean zone 110.

The heated fluid generation system 100 includes surface subsystems, such as an air subsystem 118, a fuel subsystem 124, and a treatment fluid subsystem 140. As illustrated, the air subsystem 118, the fuel subsystem 124, and the treatment fluid subsystem 140 provide an air supply 120, a fuel supply 126, and a treatment fluid 142 (e.g., water, hydrocarbon, or other fluid), respectively, to a flow control manifold 114. The respective air supply 120, fuel supply 126, and treatment fluid 142 is apportioned and supplied to the heated fluid generator 112 by and/or through the flow control manifold 114 and through an air conduit 144, a fuel conduit 146, and a treatment fluid conduit 148, respectively. Further control (e.g., throttling) of the air supply 120, fuel supply 126, and treatment fluid 142 may be accomplished by an airflow control valve 150, a fuel flow control valve 152, and a treatment fluid flow control valve 154 positioned in the respective air conduit 144, fuel conduit 146, and treatment fluid conduit 148.

The airflow control valve 150, fuel flow control valve 152, and treatment fluid flow control valve 154 are illustrated as downhole flow control components within the vertical well bore 102. Alternatively, one or more of the airflow control valve 150, fuel flow control valve 152, and treatment fluid flow control valve 154 may be configured up hole within their respective conduits (e.g., above and/or at the terranean surface 104).

In some embodiments, one or more of the airflow control valve 150, fuel flow control valve 152, and treatment fluid flow control valve 154 may be check or one-way valves on one or more of the respective conduits 144, 146, and 148. The check valves may prevent backflow of the air supply 120, fuel supply 126, and treatment fluid 142 or other fluids contained in the well bore 102, and, therefore, provide for improved safety at a well site during heated fluid treatment. The valves 150, 152, and 154 may also be pressure operated check valves. For example, the valves 152 and 150 may be pressure operated valves that are maintained in an opened position, permitting the supply fuel and supply air 126 and 120, respectively, to flow to the heated fluid generator 112 so long as the treatment fluid 142 is maintained at a defined pressure. When the pressure of the treatment fluid 142 drops below the defined pressure, the valves 152 and 150 close, cutting off the flows of fuel and air. As a result, the combustion within heated fluid generator 112 may be stopped. This can prevent destruction (e.g., burning) of the heated fluid generator 112 if the treatment fluid 142 is stopped. In such a configuration, treatment fluid 142 (e.g., water) must be flowing to the heated fluid generator 112 in order for fuel and air to be permitted to flow to the heated fluid generator 112.

As illustrated, the air subsystem 118 includes an air compressor 116 in fluid communication with the flow control manifold 114. The supply air 120 is provided to the flow control manifold 114 from the air compressor 116. The air compressor 116 may thus receive an intake of air (or other combustible fluid, such as oxygen) and add energy to the intake flow of air, thereby increasing the pressure of the air provided to the flow control manifold 114. According to some implementations, the compressor 116 includes a turbine and a fan joined by a shaft (not shown) extending through the compressor 116. Air is drawn into an inlet end of compressor and subsequently compressed by the fan. In certain embodiments including a turbine, the air compressor 116 may be a turbine compressor or other types of compressor, including compressors powered by an internal combustion engine. Of course, the air may be or include air enriched with $O_2$, air balanced with $N_2$ or $CO_2$, or any sort of oxidizer.

As illustrated, the fuel subsystem 124 includes a fuel compressor 122 in fluid communication with the flow control manifold 114. The supply fuel 126 (e.g., methane, gasoline, diesel, propane, or other liquid or gaseous combustible fuel) is provided to the flow control manifold 114 from the fuel compressor 122. The fuel compressor 122 may thus receive an intake of fuel and add energy to the intake flow of fuel, thereby increasing the pressure of the fuel provided to the flow control manifold 114. According to some implementations, the compressor 122 can be a turbine compressor or other type of compressor, including a compressor powered by an internal combustion engine. In some embodiments, the fuel compressor 122 may generate waste heat, such as, for example, by combusting all or a portion of a fuel supplied to the compressor 122. The waste heat may be used to preheat the treatment fluid 142. Additionally, waste heat from other sources (e.g., waste heat from a power plant used to drive a boost pump 128, and other sources of waste heat) may also be used to preheat the treatment fluid 142.

The treatment fluid subsystem 140, as illustrated, includes the boost pump 128 in fluid communication with a treatment fluid source 130 via a conduit 132. In the illustrated embodiment, the treatment fluid source 130 is an open water source, such as seawater or open freshwater. Of course, other treatment fluid sources may be utilized in alternative embodiments, such as, for example, stored water, potable water, or other fluid or combination and/or mixtures of fluids. The boost pump 128 draws a flow of the treatment fluid source 130 through the conduit 132 and supplies the flow to a fluid treatment 134 in the illustrated embodiment. The fluid treatment 134, for example, may clean, filter, desalinate, and/or otherwise treat the treatment fluid source 130 and output a treated treatment fluid 136 to a treatment fluid pump 138. The treated treatment fluid 136 is pumped to the flow control manifold 114 by the treatment fluid pump 138 as the treatment fluid 142.

The flow control manifold 114, as illustrated, receives the supply air 120, the supply fuel 126, and the treatment fluid 142 and provides regulated flows of the supply air 120, the supply fuel 126, and the treatment fluid 142 downhole to the heated fluid generator 112. As illustrated, the flow control manifold 114 receives a control signal 170 from the control hardware 168.

The controller 164 supplies one or more control signal outputs 166 to the control hardware 168. In some embodiments, the controller 164 may be a computer including one or more processors, one or more memory modules, a graphical user interface, one or more input peripherals, and one or more network interfaces. The controller 164 may execute one or more software modules in order to, for example, generate and transmit the control signal outputs 166 to the control hardware 168. The processor(s) may execute instructions and manipulate data to perform the operations of the controller 164. Each processor may be, for example, a central processing unit (CPU), a blade, an application specific integrated circuit (ASIC), or a field-programmable gate array (FPGA). Regardless of the particular implementation, "software" may include software, firmware, wired or programmed hardware, or any combination thereof as appropriate. Indeed, software executed by the controller 164 may be written or described in any appropriate computer language including C, C++, Java, Visual Basic, assembler, Perl, any suitable version of 4GL, as well as others. For example, such software may be a composite application, portions of which may be implemented as Enterprise Java Beans (EJBs) or the design-time components may have the ability to generate run-time implementations into different platforms, such as J2EE (Java 2 Platform, Enterprise Edition) or Microsoft's .NET. Such software may include numerous other sub-modules or may instead be a single multi-tasked module that implements the various features and functionality through various objects, methods, or other processes. Further, such software may be internal to controller 164, but, in some embodiments, one or more processes associated with controller 164 may be stored, referenced, or executed remotely. In some embodiments, a plurality of remote controllers are centrally coordinated in a distributed hierarchical control scheme.

The one or more memory modules may, in some embodiments, include any memory or database module and may take the form of volatile or non-volatile memory including, without limitation, magnetic media, optical media, random access memory (RAM), read-only memory (ROM), removable media, or any other suitable local or remote memory component. Memory may also include, along with the aforementioned solar energy system installation-related data, any other appropriate data such as VPN applications or services, firewall policies, a security or access log, print or other reporting files, HTML files or templates, data classes or object interfaces, child software applications or subsystems, and others.

The controller 164 communicates with one or more components of the heated fluid generation system 100 via one or more interfaces. For example, the controller 164 may be communicably coupled to one or more controllers of the air subsystem 118, the fuel subsystem 124, and the treatment fluid subsystem 140, as well as the control hardware 168. For example, the controller 164 may be a master controller communicably coupled to, and operable to control, one or more individual subsystem controllers (or component controllers). The controller 164 may also receive data from one or more components of the heated fluid generation system 100, such as the flow control manifold 114 (via manifold feedback 162), the sensor 158 (via sensor feedback 160), as well as the subsystems 118, 124, and 140. In some embodiments, such interfaces may include logic encoded in software and/or hardware in a suitable combination and operable to communicate through one or more data links. More specifically, such interfaces may include software supporting one or more communications protocols associated with communication networks or hardware operable to communicate physical signals to and from the controller 164.

In some embodiments, the controller 164 may provide an efficient method of safely controlling the supply fuel, the supply air, and the treatment fluid (e.g., heated water, steam, and/or a combination thereof) for downhole steam generation. The controller 164 may also greatly reduce failures that could occur by using separate controllers or a manual control system. During the steam generation process, air, gas, and water are pumped downhole where the fuel is burned and the energy generated is used to heat the water into a partial phase change. To automate this process the flow of air, gas and fuel may be controlled and sensors at those inputs may be combined with those downhole (e.g., sensor 158) in the proximity of the burn chamber and used as feedback to the controller 164.

In operation, the controller 164 may sweep one or more uphole (e.g., surface or near surface) parameters and measure (or receive measurements of) one or more downhole conditions that change based on the sweep of the uphole parameter(s). Subsequently, based on sweeping the uphole parameter(s) and measuring the downhole condition(s), the controller 164 may estimate an unmeasurable wellbore parameter, such as, for example, steam quality, combustion quality, or other parameter. In some aspects, by estimating such unmeasurable qualities, the controller 164 may provide to an operator one or more indications of the efficiency, mechanical health of the heated fluid generator 112, the conduits 144, 146, and 148, and other components of the system 100.

In some aspects, the controller 164 sweeps (i.e., incrementally adjust a value within a range) a ratio of a sum of the mass flow rate of the fuel 126 and mass flow rate of the air 120 (i.e., the combined mass flow rate of the combustion products delivered to the heated fluid generator 112) to the mass flow rate of the treatment fluid 142. For instance, in some aspects, the mass flow rate of the treatment fluid 142 (e.g., water) is held substantially constant and/or assumed to be substantially constant. Thus, the controller 164 may sweep the mass flow rate of the combustion products (i.e., the air 120 and the fuel 126) within a particular range. The controller 164 may also measure (e.g., receive measurements) one or more downhole conditions, such as, for example, a temperature of the heated fluid 108 and/or a pressure of the heated fluid 108. In some aspects, the sensors 158 may measure the temperature of the heated fluid 108 and/or the pressure of the heated fluid 108. Of course, such parameters may be measured by other sensors and/or at other locations in the system 100. Based on sweeping the mass flow rate of the combustion products (i.e., the air 120 and the fuel 126) and measuring the temperature of the heated fluid 108 and/or the pressure of the heated fluid 108, the controller 164 may estimate a quality, such as a steam quality, of the heated fluid 108.

Figure 2:
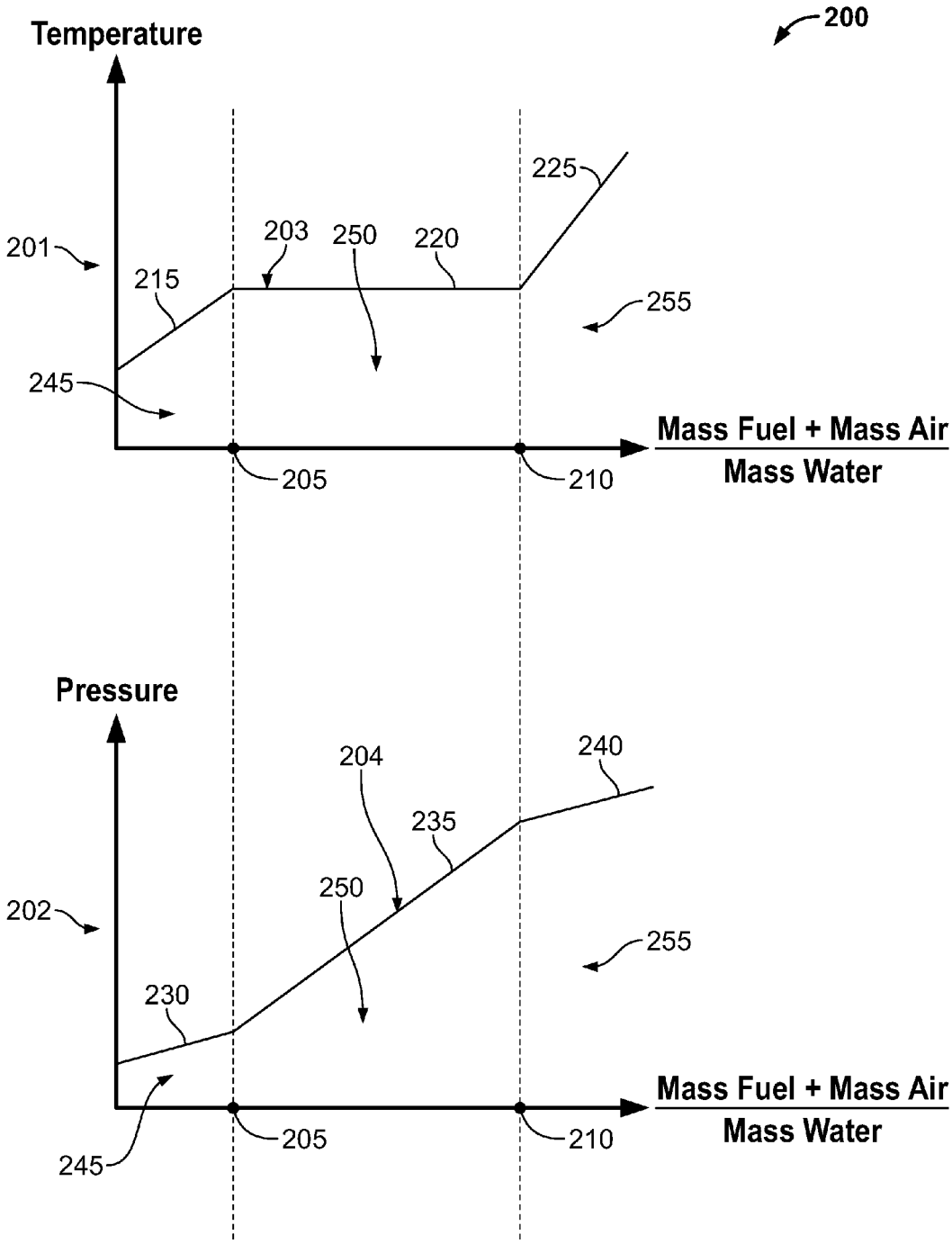
FIG. 2 illustrates a graphical system showing characteristics of a heated fluid generation system.

FIG. 2 illustrates one or more characteristics of a heated fluid generation system, such as temperature and pressure, through a graphic system 200. In some embodiments, the graphic system 200 may illustrate measured characteristics of a heated fluid, such as the heated fluid 108, of a downhole heated fluid generation system, such as the system 100 illustrated in FIG. 1. For instance, as described above, the graphical system 200 may represent one or more processes, calculations, and/or algorithms executed by the controller 164 of the system 100 in sweeping a mass flow rate of the combustion products (i.e., the air 120 and the fuel 126) and measuring a temperature of the heated fluid 108 and/or a pressure of the heated fluid 108.

As illustrated, graphic system 200 includes a graphic subsystem 201 illustrating a temperature of the heated fluid 108 as a function of the ratio of the sum of the mass flow rate of the fuel 126 and mass flow rate of the air 120 to the mass flow rate of the treatment fluid 142. A temperature curve 203 having segments 215, 220, and 225 is illustrated showing the temperature of the heated fluid 108 as a function of the ratio of the sum of the mass flow rate of the fuel 126 and mass flow rate of the air 120 to the mass flow rate of the treatment fluid 142. Temperature curve 203 increases through a range bounded on a lower end by 0 (e.g., no combustion or little combustion taking place in the heated fluid generator 112) and on an upper end by a particular (e.g., predetermined) ratio. As described above, in some aspects, the mass flow rate of the treatment fluid 142 may be held substantially constant, thereby providing, in graphic sub-system 201, for an illustration of the temperature of the heated fluid 108 as a function of the sum of the mass flow rate of the fuel 126 and mass flow rate of the air 120 (i.e., sum of the flow rates of the combustion products).

The temperature curve 203 illustrates the measured temperature of the heated fluid 108 (e.g., by sensors 158) at an outlet of the heated fluid generator 112 (or other downhole location proximate to the subterranean zone 110) over a range of the uphole parameters of mass flow rate of fuel 126 and mass flow rate of air 120. In other words, the controller 164 (or other controller or controllers) may operate the air subsystem 118 and fuel subsystem 124 to provide a combination of air 120 and fuel 126 at varying flow rates over a predetermined range, as illustrated in graphic sub-system 201. As illustrated, the temperature curve 203 varies, because, for instance, a combined mass flow rate (or volumetric flow rate) of fuel 126 and air 120 reflects a corresponding amount of energy being delivered into the heated fluid generator 112, i.e., combustion energy.

Graphic sub-system 202 illustrates a pressure of the heated fluid 108 as a function of the ratio of the sum of the mass flow rate of the fuel 126 and mass flow rate of the air 120 to the mass flow rate of the treatment fluid 142. A pressure curve 204 having segments 230, 235, and 240 is illustrated showing the pressure of the heated fluid 108 as a function of the ratio of the sum of the mass flow rate of the fuel 126 and mass flow rate of the air 120 to the mass flow rate of the treatment fluid 142. Pressure curve 204 increases through a range bounded on a lower end by 0 (e.g., no combustion or little combustion taking place in the heated fluid generator 112) and on an upper end by a particular (e.g., predetermined) ratio. More particularly, when the mass flow rate of the treatment fluid 142 is held substantially constant, graphic sub-system 202 illustrates the pressure of the heated fluid 108 as a function of the sum of the mass flow rate of the fuel 126 and mass flow rate of the air 120.

The pressure curve 204 illustrates the measured pressure of the heated fluid 108 (e.g., by sensors 158) at the outlet of the heated fluid generator 112 (or other downhole location proximate to the subterranean zone 110) over a range of the uphole parameters of mass flow rate of fuel 126 and mass flow rate of air 120. As described above with respect to the temperature curve 203, the pressure curve 204 varies because, for instance, a combined mass flow rate (or volumetric flow rate) of fuel 126 and air 120 reflects a corresponding amount of energy being delivered into the heated fluid generator 112, i.e., combustion energy.

Combustion energy points 205 and 210 are illustrated in graphic sub-systems 201 and 202, representing particular amounts of combustion energy at corresponding mass (or volume) flow rates of the fuel 126 and the air 120. As discussed below, combustion energy point 205 may represent a particular combustion energy (i.e., mass flow rate of fuel and air) to deliver heated treatment fluid 108 (i.e., steam) from the heated fluid generator 112 at 0% steam quality. Combustion energy point 210 may represent a particular combustion energy (i.e., mass flow rate of fuel and air) to deliver heated treatment fluid 108 (i.e., steam) from the heated fluid generator 112 at 100% steam quality.

As illustrated, a portion 245 of graphic sub-systems 201 and 202 represents the heated fluid 108 at 100% liquid (e.g., 100% water). In such situations, the combustion energy delivered to the heated fluid generator 112 is insufficient to cause the treatment fluid 142 to boil. The result in the case of the treatment fluid 142 being water is that hot water is produced by the generator 112 and delivered to the subterranean zone 110. This may be determined by the controller 164, for example, with reference to the segments 215 and 230 of the temperature curve 203 and pressure curve 204, respectively. For instance, while these segments 215 and 230 change (e.g., increase) as a function of the delivered combustion energy (i.e., the combined mass flow rate of fuel 126 and air 120), the segments 215 and 230 may still be below known values for boiling the treatment fluid 142.

As illustrated, a portion 250 of graphic sub-systems 201 and 202 represents the heated fluid 108 at a mixture of vapor and liquid, such as a mixture of steam and water. As shown, portion 250 may be bounded at a lower end by combustion point 205 (i.e., 0% steam quality). For instance, combustion point 205 may represent a state of the treatment fluid 142 just as it changes phase from 100% liquid to a mix of liquid and vapor. Portion 250 may be bounded at an upper end by combustion point 210 (i.e., 100% steam quality). For instance, combustion point 210 may represent a state of the treatment fluid 142 just as it changes phase from a mix of liquid and vapor to 100% vapor. As illustrated, when the combined mass flow rate of the fuel 126 and air 120 delivered to the heated fluid generator 112 is increased, additional energy is being added to the generator.

When sufficient energy is added, such as at combustion point 205, the heated fluid 108 (i.e., water) begins to boil. The transition into boiling is noted by the temperature curve 203 at segment 220 remaining constant or substantially constant while the pressure curve 204 at segment 235 increases (e.g., significantly) as the combined mass flow rate of the fuel 126 and air 120 delivered to the heated fluid generator 112 is increased. The temperature curve 203 at segment 220 is constant, because this is the boiling temperature of the heated fluid 108. The pressure curve 204 at segment 235 rises more rapidly (i.e., has a larger positive slope), because a density of the heated fluid 108 is falling as a percentage of vapor in the vapor-liquid mixture increases. In some embodiments, such as when the treatment fluid 142 is water, a higher steam percentage leads to lower density, which leads to higher flow velocity of the heated treatment fluid 108. In some aspects, at such higher flow velocities, the flow of heated treatment fluid 108 may experience a greater pressure drop across any downstream obstructions, such as check valves, in the system 100. Further, the pressure drop could also be created by the injection pressure of the heated treatment fluid 108 into the formation.

As illustrated, a portion 255 of graphic sub-systems 201 and 202 represents the heated fluid 108 at 100% vapor and, more specifically, as the heated fluid 108 becomes a superheated steam (in the case of water as the treatment fluid 142). As shown, portion 255 may be bounded at a lower end by combustion point 210 (i.e., 100% steam quality). As illustrated, as the heated fluid 108 is converted to 100% vapor (i.e., steam), the temperature curve 203 at segment 225 rises more quickly, while the pressure curve 204 at segment 240 rises more slowly.

Based on the measured properties, the controller 145 may be able to estimate a quality of the heated treatment fluid 108 throughout a range of values of the combined mass flow rate of the fuel 126 and air 120 based on a sweep of a particular portion of the range of such values. For instance, the controller 145 may sweep the combined mass flow rate of the fuel 126 and air 120 from a low rate (e.g., at the lower bound of segments 215/230) to a high rate (e.g., at an upper bound of segments 225/240). The controller 145 may then estimate a quality of the heated treatment fluid 108 (e.g., a steam quality) at 0% quality and 100% quality by determining the points of intersection of segments 215 and 220 (for 0% quality) and segments 220 and 225 (for 100% quality) on the temperature curve 203. Alternatively, or additionally, the controller 145 may estimate a quality of the heated treatment fluid 108 at 0% quality and 100% quality by determining the points of intersection of segments 230 and 235 (for 0% quality) and segments 235 and 240 (for 100% quality) on the pressure curve 204. In other words, the controller may estimate the quality at these points due to the changes in slope of the temperature curve 203 and/or pressure curve 204.

In some aspects, the controller 145 may estimate the fluid quality at combustion points 205 and 210 (i.e., points where the slope changes for the temperature curve 203 and the pressure curve 204) and the fluid quality can be estimated for additional combustion points through linear interpolation and/or extrapolation, i.e., by assuming that fluid quality varies linearly as a function of the combined mass flow rate of the fuel 126 and air 120).

In alternative embodiments, the controller 145 may generate and/or execute a numerical model of the system 100 in order to estimate the fluid quality (i.e., steam quality). The numerical model, in some aspects, may be an observer-based estimator where, for example, dynamics and time delays of the components of system 100 (e.g., valves, conduits, manifold) would be included in the model. For instance, pressure drops across valves, such as the valves 150, 152, and 154, as well as across the heated fluid generator 112, could also be included in the model. Further, heat transfer and system inefficiencies may be included in the numerical model. Increased detail in the numerical model may allow for a better estimation of the fluid quality as the system 100 is changed. For example, operating at a set point of combined flow rate of fuel and air outside of a swept range that is different from the point where the sweep occurred. Additionally. added detail in the numerical model may allow for a better understanding of the mechanical health of the system 100 (e.g., amount of fouling and/or scale in the system components) and a better understanding of which part of the system 100 is changing when the mechanical health is compromised. Moreover, by utilizing a sweep of one or more input parameters, an inherently nonlinear system may be transformed into a series of linear control systems. For example, the sweep linearizes the dynamics around the sweep point. The control of these linearized systems can be controlled, therefore, via a method known as sliding mode control.

Figure 3:
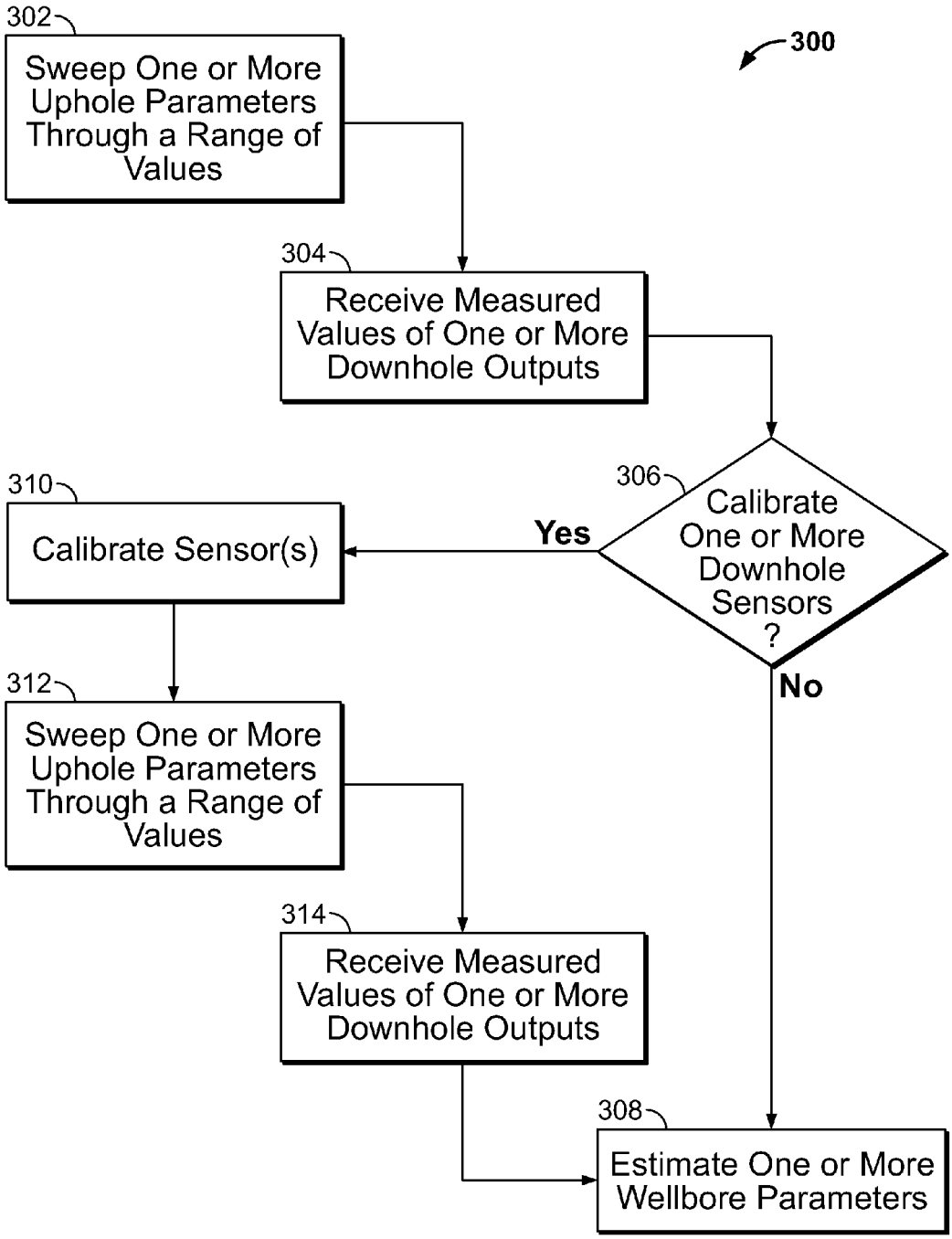
FIG. 3 illustrates an example heated fluid generation process for estimating a wellbore parameter.

FIG. 3 illustrates an example heated fluid generation process 300 for estimating a wellbore parameter. In some embodiments, the process 300 may be executed by a system for providing a heated fluid, such as steam, to a subterranean zone, such as the system 100 illustrated in FIG. 1. Process 300 may begin at step 302, when a controller (e.g., a main controller or one or more individual controllers) of a heated fluid generation system sweeps one or more uphole parameters through a range of values. For example, as described above, the controller 164 of system 100 may sweep a combined mass flow rate of fuel 126 and air 120 delivered to the heated fluid generator 112 through a range of values. In other words, the controller 164 (or controllers coupled to specific components of the system 100) may command the fuel subsystem 124 and/or air subsystem 118 to periodically increase (or decrease) the mass flow rate of fuel 126 and/or air 120, respectively, delivered to the heated fluid generator 112 over a specified range of mass flow rate values. The range of values may be, for example, substantially zero combined mass flow through a maximum combined mass flow rate of fuel 126 and/or air 120 deliverable to the heated fluid generator 112. Alternatively, the range of values may be smaller and more focused about a specific combined mass flow rate of the fuel and air (i.e., a more specific combustion energy point). For instance, the controller 164 may sweep the combined mass flow rate in a range of values close to a specific combined mass flow rate operable to deliver a combustion energy to boil a treatment fluid, such as the combined mass flow rate at combustion point 205.

Further, process 300 may include sub-steps that are part of, or in addition to, the illustrated step 302. For instance, the controller 164 may make three sweeps of the combined mass flow rate of fuel 126 and air 120 delivered to the heated fluid generator 112 through three different ranges of values. For instance, the first sweep may be from a substantially zero combined mass flow rate of fuel and air to a maximum combined mass flow rate of fuel 126 and/or air 120. This sweep, as described above with reference to FIG. 2, may identify specific combustion energy points, such as combustion energy points 205 and 210 which identify a combustion energy at which the treatment fluid boils and a combustion energy at which the treatment fluid becomes 100% vapor (e.g., 100% steam). The first sweep, however, may only approximate the specific combustion energy points. The second sweep may be more tightly focused on one of the identified points, such as combustion point 205. Thus, the range of the second sweep may be smaller, and at smaller increments of change (i.e., small increases or decreases in the combined mass flow rate of air and fuel), as compared to the first sweep. Thus, the second sweep may more specifically identify the combined mass flow rate of fuel and air at which combustion point 205 occurs.

Likewise, the third sweep may be more tightly focused on another identified point, such as combustion point 210. The range of the third sweep may also be smaller, but at smaller increments of change (i.e., small increases or decreases in the combined mass flow rate of air and fuel) as compared to the first sweep. Thus, the third sweep may more specifically identify the combined mass flow rate of fuel and air at which combustion point 210 occurs.

Subsequent to or substantially simultaneous with step 302, the controller 164 may receive measured values of one or more downhole outputs at step 304. The downhole outputs may include, for example, a temperature and/or a pressure of a heated fluid 108 output from the heated fluid generator 112. As the uphole parameters change through the sweep(s) of value ranges, the measured values of the one or more downhole outputs may also change accordingly. For example, as the combined mass flow rate of the air 120 and the fuel 126 is swept through increasing values, the received measurements of temperature and pressure may also increase, although at different rates of change as shown in FIG. 2.

At step 306, the controller 164 may determine whether one or more downhole sensors should be calibrated. For example, the controller 164 may determine, based on the received measured values of temperature and/or pressure, that a temperature sensor and/or pressure sensor should be calibrated. Alternatively, the controller 164 may receive a command, such as from a user of the controller 164, to calibrate the one or more downhole sensors based on observations of the received measurements. In addition, the controller 164 may provide an indication (e.g., an alarm or signal or other notification) to the user that the one or more downhole sensors should be calibrated.

In some aspects, the downhole sensors may be calibrated based on received measurements of temperature and/or pressure (or other values, such as flow rate of the fuel, the air, and/or the treatment fluid 142) indicating a mechanical health issue in the system 100. For instance, significant changes in the flow rate (e.g., flow rate of the fuel 126, the air 120, and/or the treatment fluid 142) may be an indication that the downhole heated fluid generator 112 is experiencing problems, such as fouling in the supply lines, erosion in the valves, or other mechanical problems. Further, the sweep of the uphole parameters in step 302 may be combined with additional measurements at or near the terranean surface for improved system health monitoring. For instance, if an injection pressure (e.g., of air, fuel, and/or treatment fluid) and mass flow rates (e.g., of air, fuel, and/or treatment fluid) are measured at or near the terranean surface, then sweeping the injection flow rate (e.g., of air, fuel, and/or treatment fluid) may allow for characterization of the fouling in one or more conduits (e.g., conduits 144, 146, and/or 148), in the orifices, and/or in the heated fluid generator 112. Further, combining the surface measurements with the downhole measurements received in step 304 into a numerical model, as described above, may provide an accurate understanding of the system performance and system health.

If a determination is made not to calibrate the one or more downhole sensors at step 306, then the controller 164 estimates one or more wellbore parameters based on the received measured values at step 308. For example, as described above with reference to FIG. 2, a heated fluid quality, such as steam quality, may be estimated based on the received measurements of temperature and/or pressure (or other downhole outputs). In some aspects, the downhole outputs may be characteristics of the system 100 regularly and/or easily measured with confidence and/or accuracy. For instance, temperature and pressure of the heated fluid 108, or indeed many fluids circulated downhole, are often measured with standard or typical sensors. Moreover, such sensors may be typical components on all or a vast majority of heated fluid generators or downhole heated fluid systems. The estimated wellbore parameter, such as steam quality, may not, in some aspects, be an easily and/or regularly measured value. For instance, "steam quality" sensors may not be normally used, may be infeasible to use, and simply may not be existent for one or more applications.

If a determination is made to calibrate the one or more downhole sensors at step 306, then the sensors are calibrated at step 310. Next, the controller 164 sweeps one or more uphole parameters through a range of values again at step 312. In some aspects, step 312 may be substantially similar in execution to step 302 described above. For instance, in some aspects, an operator may perform one sweep (step 302) and measurement (step 304) in order to determine whether to calibrate the one or more downhole sensors. The operator may then perform a second sweep (step 312) or series of sweeps (as described above with respect to step 302) and receive measured values of one or more downhole outputs at step 314. Step 314 may be, in some aspects, substantially similar to step 304 described above. The controller 164 may then estimate one or more wellbore parameters based on the received measured values from step 314 at step 308. Thus, the second sweep may be for the purpose of estimating the wellbore parameter, while the first sweep may be for the purpose of calibration.

Process 300 may be implemented in many different aspects different than those described above. For example, only one of the mass flow rates of the fuel 126 and air 120 may be swept, while the other is held substantially constant. In other words, a ratio between the rates of fuel 126 and air 120 can be changed. In some aspects, this may change the temperature of combustion occurring at the heated fluid generator 112 (or other location in the system 100). This may allow for the determination of an optimal fuel-to-air ratio, as well as serve as diagnostics for system changes. Measuring the temperature of the combustion at the heated fluid generator 112 may thus show a higher temperature as compared to the temperature after the treatment fluid 142 has been boiled into a vapor.

In another aspect of process 300, the combined mass flow rate of the fuel 126 and the air 120 may be held substantially constant while a mass flow rate of the treatment fluid 142 (e.g., water) may be swept over a range of values. Further, the mass flow rate of the treatment fluid 142 and one of the mass flow rates of the air 120 and fuel 126 may be swept, while the other of the mass flow rates of the air 120 and fuel 126 may be held constant.

In another aspect of process 300, measured values of only one of temperature and pressure of the heated fluid 108 may be used to estimate a wellbore parameter, such as steam quality. Alternatively, an oxygen sensor located downhole (e.g., at, in, or near the heated fluid generator 112) may measure an amount of oxygen downhole. For example, changing the fuel-to-air ratio may change an amount of oxygen at or near the oxygen sensor as the combustion runs from lean to rich. In some aspects, measuring oxygen may show changes over time as scaling and fouling can change the efficiency of the combustion. By monitoring such changes, the operator can estimate the system mechanical health.

In another aspect of process 300, the fluid quality (e.g., steam quality) may be estimated based on received measurements from a differential pressure sensor sensing a pressure drop across an obstruction, such as, for example, a check valve through which the heated fluid 108 passes. The pressure drop across the obstruction is proportional to the mass flow rate of the heated fluid squared divided by the flow density. By measuring the pressure differential across the check valve (or equivalent obstruction that creates a pressure drop in the flow), the density of the heated fluid 108 (and thus quality of the heated fluid 108 since quality is a ratio of mass flow of vapor to mass flow of mixed liquid-vapor), can be estimated.

A number of embodiments have been described. Nevertheless, it will be understood that various modifications may be made. For example, additional aspects of process 300 may include more steps or fewer steps than those illustrated in FIG. 3. Further, the steps illustrated in FIG. 3 may be performed in different successions than that shown in the figure. Moreover, although the concepts have been described in the context of a downhole heated fluid generation system (e.g., steam injection), the concepts could be applied to other processes as well. For example, in connection with a gravel packing process, the operator could sweep flow rate, injection pressure, proppant or gravel size, proppant or gravel concentration, and/or gel strength and correspondingly measure flow rate and/or pressure in order to estimate alpha wave progress, beta wave progress, formation fracture initiation, fracture closure, fracture growth, and/or screen out. Accordingly, other embodiments are within the scope of the following claims.

What is claimed is:

1. A method for estimating a downhole wellbore parameter, comprising:

adjusting a characteristic of an input fluid to a wellbore through a first range of input values of the input fluid;

measuring, in the wellbore, a first plurality of output values of the input fluid that vary in response to the first range of input values, the first plurality of output values representative of a downhole condition of a downhole system;

based on the measured first plurality of output values, calibrating at least one downhole sensor operable to measure the first plurality of output values;

subsequent to the calibration, adjusting the characteristic of the input fluid to the wellbore through a second range of input values;

measuring, in the wellbore, a second plurality of output values of the input fluid that vary in response to the input values in the second range, the second plurality of output values representative of the downhole condition; and estimating a wellbore parameter distinct from the downhole condition based on the measured second plurality of output values.

2. The method of claim 1, wherein the downhole system comprises a heated fluid generation system.

3. The method of claim 2, wherein the estimated wellbore parameter comprises a steam quality.

4. The method of claim 2, wherein adjusting a characteristic of an input fluid comprises adjusting a flow rate of the input fluid.

5. The method of claim 4, wherein the input fluid comprises at least one of:

a fuel used for combustion;

air used for combustion;

a combined of the fuel and the air used for combustion; and a treatment fluid delivered to a combustor of the heated fluid generation system.

6. The method of claim 2, wherein the measured output values comprise a plurality of measured values representative of at least one of:

a temperature of a heated fluid output from the heated fluid generation system used to treat a subterranean zone;

a pressure of the heated fluid output from the heated fluid generation system used to treat a subterranean zone;

an amount of oxygen in a wellbore at or near a downhole combustor in the heated fluid generation system; and a pressure drop across an orifice in the heated fluid generation system.

7. The method of claim 2, further comprising identifying a first output value among the first plurality of output values, wherein the first output value is associated with a change to a rate of change of the downhole condition.

8. The method of claim 7, wherein the first output value comprises at least one of:

a value representative of an amount of combustion energy necessary to convert at least a portion of a treatment liquid supplied to a combustor of the heated fluid generation system to vapor; and a value representative of an amount of combustion energy necessary to convert substantially all of the treatment liquid supplied to the combustor of the heated fluid generation system to vapor.

9. The method of claim 1, wherein the estimated wellbore parameter is indicative of a mechanical health of the downhole system.

10. The method of claim 1, wherein adjusting a characteristic of an input fluid to a wellbore through a first range of input values comprises adjusting the characteristic of the input fluid at or near a terranean surface.

11. The method of claim 1, wherein the downhole system comprises a gravel packing system.

12. The method of claim 11, wherein the estimated wellbore parameter comprises a location of an injected particulate.

13. The method of claim 12, wherein the injected particulate comprises at least one of gravel or proppant.

14. The method of claim 1, wherein calibrating at least one downhole sensor operable to measure the first plurality of output values comprises at least one of:

calibrating the at least one downhole sensor based at least in part on the measured first plurality of output values of the input fluid that are measured in the wellbore;

calibrating the at least one downhole sensor based at least in part on a command from a user; or;

calibrating the at least one downhole sensor based at least in part on an alarm.

15. The method of claim 14, wherein calibrating the at least one downhole sensor based at least in part on the measured first plurality of output values of the input fluid comprises:

measuring, at or near a terranean surface, a third plurality of output values of the input fluid that vary in response to the input values;

comparing the measured first plurality of output values of the input fluid that are measured in the wellbore to the measured third plurality of output values of the input fluid that vary in response to the input values; and based on the comparison of the measured first plurality of output values and the measured third plurality of output values, calibrating the at least one downhole sensor.

16. The method of claim 15, further comprising:

determining a fouling factor based on the comparison of the measured first plurality of output values and the measured second plurality of output values.

17. A system for estimating a wellbore parameter, comprising:

a first component located at or near a terranean surface;

a second component at least partially disposed within a wellbore at or near a subterranean zone, the second component associated with a sensor; and a controller communicably coupled to the first and second components, the controller operable to:

adjust a characteristic of an input fluid to the wellbore through a first range of input values of the input fluid;

receive, from the sensor, a first plurality of output values of the input fluid that vary in response to the input values, the first plurality of output values representative of a downhole condition; and receive a second plurality of output values of the input fluid that are measured at or near the terranean surface and vary in response to the input values;

compare the measured first plurality of output values of the input fluid that are measured in the wellbore to the measured second plurality of output values of the input fluid that vary in response to the input values;

based on the comparison of the measured first plurality of output values and the measured second plurality of output values, calibrate the sensor; and estimate a wellbore parameter distinct from the downhole condition based on the measured output values.

18. The system of claim 17, wherein the first and second components comprise at least a portion of one of:

a heated fluid generation system; or a gravel packing system.

19. The system of claim 18, wherein the estimated wellbore parameter comprises a steam quality.

20. The system of claim 18, wherein the characteristic of the input fluid comprises a flow rate of at least one fluid used for combustion in the heated fluid generation system.

21. The system of claim 20, wherein the flow rate of the at least one fluid used for combustion comprises at least one of:

a flow rate of a fuel used for combustion;

a flow rate of air used for combustion; and a combined mass flow rate of the fuel and air used for combustion.

22. The system of claim 18, wherein the characteristic of the input fluid comprises a flow rate of a treatment fluid delivered to a combustor of the heated fluid generation system.

23. The system of claim 18, wherein the measured output values comprise a plurality of measured values representative of at least one of:

a temperature of a heated fluid output from the heated fluid generation system used to treat the subterranean zone;

a pressure of the heated fluid output from the heated fluid generation system used to treat the subterranean zone;

an amount of oxygen in the wellbore at or near a downhole combustor in the heated fluid generation system;

a pressure drop across an orifice in the heated fluid generation system; and a pressure differential across a gravel pack at least partially disposed in the wellbore.

24. The system of claim 18, wherein the controller is further operable to identify a first output value among the plurality of output values, wherein the first output value is associated with a change to a rate of change of the downhole condition.

25. The system of claim 24, wherein the first output value comprises at least one of:

a value representative of an amount of combustion energy necessary to convert at least a portion of a treatment liquid supplied to a combustor of the heated fluid generation system to vapor; and a value representative of an amount of combustion energy necessary to convert substantially all of the treatment liquid supplied to the combustor of the heated fluid generation system to vapor.

26. The system of claim 17, wherein the controller is further operable to calibrate the sensor based, at least in part, on at least one of the measured first plurality of output values of the input fluid that are measured in the wellbore;

a command from a user; or;

an alarm generated by the controller.

27. The system of claim 17, wherein the controller is further operable to:

determine a fouling factor based on the comparison of the measured first plurality of output values and the measured second plurality of output values.

* * * * *